US006009864A

United States Patent [19]

Basso et al.

[11] Patent Number: 6,009,864

[45] **Date of Patent: *Jan. 4, 2000**

[54] CAPACITIVE IGNITION SYSTEM FOR INTERNAL COMBUSTION ENGINES

[75] Inventors: Steven Michael Basso, Bedford; Martin John Peter Cebis, Wembley Downs, both of Australia

[73] Assignee: Orbital Engine Co. ( Australia) Pty. Limited, Balcatta, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/783,302

[22] Filed: Jan. 10, 1997

Related U.S. Application Data

[63] Continuation of application No. 08/454,150, filed as application No. PCT/AU93/00664, Dec. 20, 1993, abandoned.

[30] Foreign Application Priority Data

Dec. 24, 1992 [AU] Australia ..... PL 6590

[51] Int. Cl.[7] ..... F02P 3/08

[52] U.S. Cl. ..... 123/599; 123/605; 315/209 CD; 315/218; 361/256

[58] Field of Search ..... 123/599, 601, 123/602, 605, 620, 596; 315/209 CD, 218; 361/256, 257

[56] References Cited

U.S. PATENT DOCUMENTS

| | | | |
|---|---|---|---|
| 3,234,430 | 2/1966 | Issler et al. . | |
| 3,782,353 | 1/1974 | Kammerer et al. . | |
| 3,921,606 | 11/1975 | Habert | 123/599 |
| 3,943,905 | 3/1976 | Hartig | 123/599 |
| 4,154,205 | 5/1979 | Forster . | |
| 4,345,575 | 8/1982 | Jorgensen | 123/598 |
| 4,558,683 | 12/1985 | Okuda . | |
| 4,886,036 | 12/1989 | Johansson et al. . | |
| 4,967,037 | 10/1990 | Roberts . | |
| 5,049,786 | 9/1991 | Gotisar et al. . | |
| 5,207,208 | 5/1993 | Ward . | |

FOREIGN PATENT DOCUMENTS

| | | | |
|---|---|---|---|
| 0270162 | 11/1987 | European Pat. Off. . | |
| 2237837 | 2/1974 | Germany | 123/605 |
| 25 20 485 | 11/1975 | Germany . | |
| 3131844 | 10/1981 | Germany . | |
| 30 43 603 | 7/1982 | Germany . | |
| 217580 | 9/1983 | Germany . | |
| 34 42 017 | 5/1986 | Germany . | |
| 3822794 | 7/1988 | Germany . | |
| 298666 | 5/1971 | U.S.S.R. | 123/605 |
| 842213 | 6/1981 | U.S.S.R. | 123/599 |
| 1268290 | 10/1970 | United Kingdom . | |

OTHER PUBLICATIONS

European Search Report, Apr. 26, 1994, for application EP 91920514.

(PCT) International Publication No. WO 92/08891 published May 29, 1992.

*Primary Examiner*—Andrew M. Dolinar

*Attorney, Agent, or Firm*—Nikaido, Marmelstein, Murray & Oram, LLP

[57] ABSTRACT

An ignition system for use in internal combustion engines, in which there is provided a plurality of charging means, at least one of the plurality of charging means being adapted to provide charge to a plurality of charge storage means, in a predetermined manner, the charge storage means being arranged to collectively activate a spark means.

24 Claims, 2 Drawing Sheets

CAPACITIVE IGNITION SYSTEM FOR INTERNAL COMBUSTION ENGINES

This application is a continuation of application Ser. No. 08/454,150 filed Jun. 13, 1995, now abandoned, which is a national application filed under 35U.S.C. 371 of international application PCT/AU93/00664, filed Dec. 20, 1993.

FIELD OF INVENTION

The present invention relates to a method of producing spark in an ignition system, particularly a capacitive discharge ignition system for internal combustion engines and also to an improved capacitive discharge ignition system therefor.

1. Related Application

The present invention is related to the disclosure in PCT/AU91/00524 filed by the present Applicant on Nov. 15, 1991. The contents of the PCT application are herein incorporated by reference.

2. Background Art

In the motor industry, there has been a trend to use electronic ignition systems to improve the efficiency and performance of internal combustion engines by producing a spark with desired characteristics to initiate combustion of an air-fuel mixture, particularly the lean mixtures encountered in stratified charge engines.

Nevertheless, in the case of capacitive discharge ignition systems, where sufficient spark voltage can build up in a relatively short period, it has been found that the spark produced by the spark voltage is typically of relatively brief duration. Such relatively brief spark duration characteristics are even more pronounced in a capacitive discharge ignition system having a low-capacitance high-voltage charge storage means such as a capacitor. A high-voltage will cause a high discharging current to pass through the primary coil of an ignition system to induce the necessary spark voltage in the secondary coil of the ignition system to produce a spark at the spark gap. However, the low-capacitance limits the duration of that current and thus, the duration of the spark produced.

It has been realised that the spark duration provided by such prior art ignition systems may sometimes be too brief to properly ignite the air-fuel mixture, particularly for a lean mixture. This may cause adverse pollution effects and may result in undesirable operating characteristics of the engine.

A proposal to merely increase the capacitance of the charge storage means or capacitor would not significantly extend the spark duration, but rather would cause a more intense spark. Another proposal to provide a resistor in the primary circuit to reduce the rate of discharge would also reduce the amount of the discharging current and the energy available for the spark.

Further, the use of transistors of the type referred to as "silicon controlled rectifiers" to initiate the discharge of energy from the charge storage means of capacitor would invariably allow the energy which has been stored in the primary coil during the discharge to dissipate within the primary circuit and also potentially prevent the use of any secondary or flyback spark if this were desired.

SUMMARY OF THE INVENTION

The present invention has as its object to alleviate some of the disadvantages discussed above.

It is an object of the present invention to provide a method of producing an improved and extended duration spark in an ignition system for internal combustion engines.

It is a further object of the present invention to provide an improved charging method and apparatus for an ignition system for use with internal combustion engines.

In accordance with one aspect of the present invention there is provided an ignition system in which there is provided a plurality of charging means, at least one of said plurality of charging means being adapted to provide a charge to a plurality of charge storage means, preferably of different storage capacity, the charge storage means being arranged to collectively activate a spark means.

In a preferred embodiment, the ignition system is used in an internal combustion engine.

Preferably, the ignition system provides at least one charging means arranged to provide at least part of the charge for at least two charge storage means. Additionally, the ignition system may include at least two charging means arranged to provide the charge for at least one charge storage means.

Preferably, at least one of the charging means is arranged to provide part or all of the charge for at least one charge storage means.

Conveniently, at least one respective charging means is arranged to be substantially matched to the capacity of at least one of the respective charge storage means. Preferably, respective charging means may be arranged to be substantially matched to the capacity of respective charge storage means.

Preferably, at least one charge storage means is of a high capacitance and at least one other charge storage means is of a low capacitance.

Furthermore, preferably the ignition system is a capacitative discharge ignition system, wherein the charge storage means are conveniently connected to the primary coil of a spark means, the spark means having a secondary coil connected to a spark gap.

The present invention is predicated on the need to provide a spark duration in excess of about 1.5 mS in an internal combustion engine.

The present invention results from the discovery that spark duration may be extended by providing more than one charging means to provide charge to more than one charge storage means and that in delivering the charge from the plurality of charging means to the plurality of charge storage means in a predetermined manner, the charge storage means are capable of delivering energy for an extended spark.

By using two charge coils instead of one, and dividing the various portions of the current waves generated thereby, the transfer of energy from the charge coils to the charge storage means is optimised, resulting in spark durations of approximately 2 mS.

The present invention seeks to optimise the use of each coil by closely matching the drive capability of each of the coils to one of each of the individual charge storage means.

In another aspect, the present invention provides a method of providing charge from a plurality of charging means to a plurality of charge storage means in an ignition system, the method including the step of distributing the charge from at least one of the plurality of charging means to a plurality of charge storage means, preferably of different capacities, in order to charge the charge storage means.

In a preferred embodiment, the method can be used for ignition of internal combustion engines.

Preferably, at least one charging means provides at least part of the charge for at least two charge storage means. Additionally, at least two charging means may provide the charge for at least one charge storage means.

Preferably, at least one of the charging means is arranged to provide part or all of the charge for at least one charge storage means.

Preferably, at least one charging means substantially matches the capacity of at least one of said charge storage means. Respective charging means may substantially match the capacity of a respective charge storage means.

Preferably, at least one charge storage means is of a high capacitance and at least one other charge storage means is of a low capacitance.

The present invention is predicated on the discovery that in the process of charging two charge storage means via two charging means instead of one, rather than using one first half of the charging wave of a single charging means to charge one first charge storage means and the other second half of the charging wave to charge a second charge storage means (until a nominal voltage is attained in the second charge storage means and then applying the residual of the second half of the charging wave to further charge the first charge storage means), an unbalanced charging methodology can be utilized to charge the two charge storage means by way of two charging means.

In a preferred form, one charge storage means is charged by receiving approximately three half wave portions made up of two half waves from a first charging means and one half wave from a second charging means, and the second charge storage means is charged by receiving the other one half wave portion from the second charging means.

This results, inter alia, in the ability to provide (a) a lower cost isolation means in the form of a relatively low cost diode instead of a higher cost zener diode as disclosed in PCT/AU91/00524 and (b) an extended spark duration of in excess of about 1.5 ms.

DESCRIPTION OF THE INVENTION

The present invention will now be described with reference to two embodiments thereof, and with reference to the accompanying drawings. It should be clearly understood, however, that the description of the embodiments, and the drawings, are given purely for the purpose of explanation and exemplification only, and are not intended to be limitative of the scope of the present invention in any way.

A dual rate capacitive discharge ignition system, for example for use in internal combustion engines, normally uses a single charge coil to generate the charge current to be distributed to two storage means. Until recently, small engines fitted with fuel injection systems have not required spark durations in excess of 1 mS. However, recent demand for more efficient combustion management in internal combustion engines and the desire to use capacitive discharge ignition systems on small engines of larger capacity requires spark durations in excess of 1.5 mS to maintain stability of combustion.

By using two charge coils instead of one, and dividing various portions of the charging waves created thereby, the transfer of energy from the charge coils to a plurality of charge storage means or capacitors is optimised, resulting in spark durations of up to 2 mS.

Twin coil arrangements in known capacitive discharge ignition systems are normally used for the purpose of maintaining a more constant combined output drive capability over a wide speed range whereas, the invention described herein optimises the use of each coil by closely matching the drive capabilities thereof to the respective capacities of the individual charge storage means. Each of the two coils of the preferred embodiments develop a full charging wave wherein said full charging waves are to be applied for the charging of two charge storage means, each of which are connected to the primary winding of an ignition coil.

Figure 1:
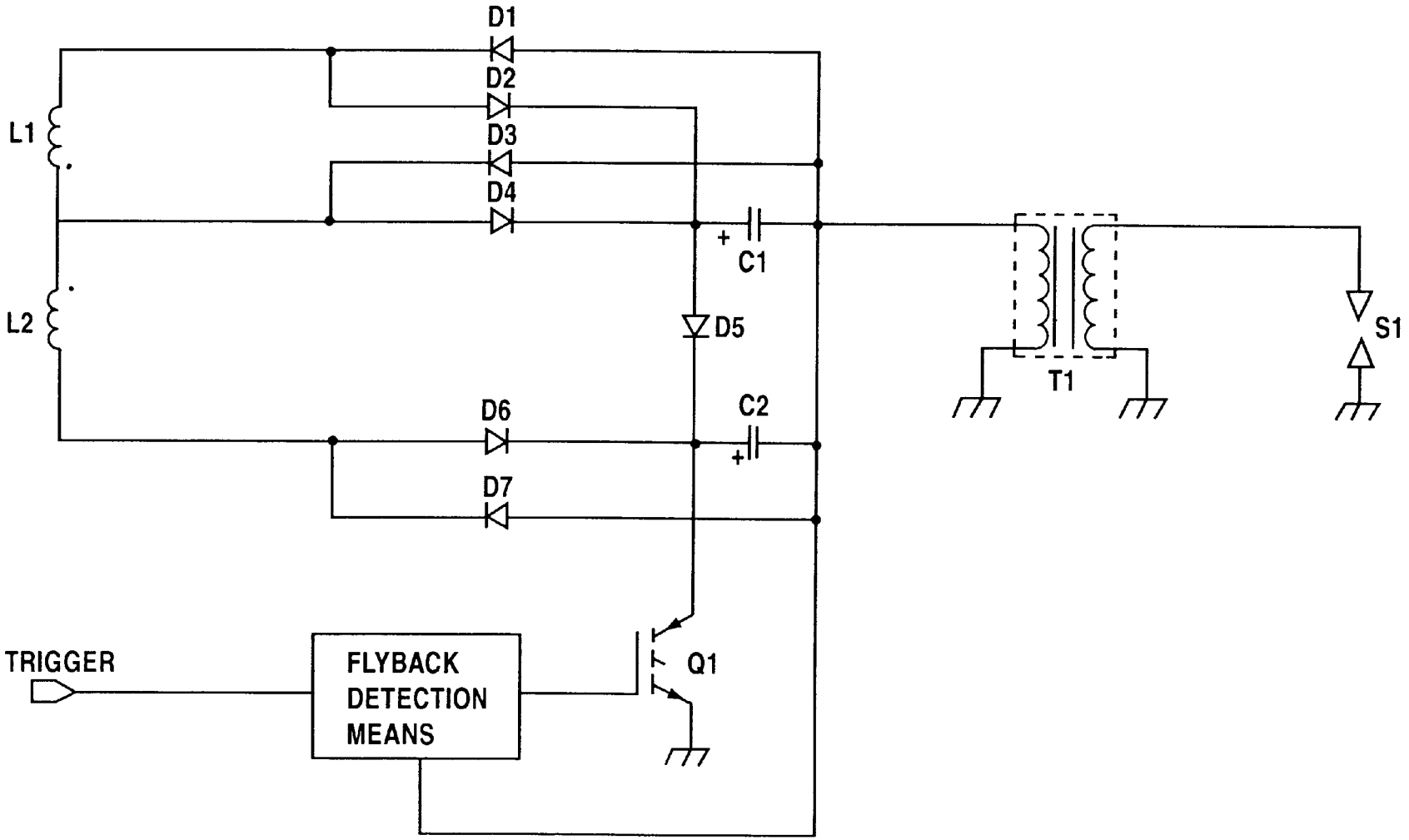
FIG. 1 shows a schematic diagram of one form of ignition system in accordance with the present invention.

In regard to the embodiment as shown in FIG. 1, one charge coil (L1) is chosen to be of relatively low impedance, and is able to deliver a substantial current into a high capacitance capacitor ("storage means C1"). The rectifier arrangement of diodes D4 and D1 and D2 and D3 allows all of the current generated by this coil (L1) to be delivered into charge storage means, C1.

The other charge coil (L2) has a much higher impedance but a correspondingly higher output voltage. Only one half of the charging wave generated thereby is required to sufficiently charge a lower capacitance capacitor ("storage means C2") to a higher voltage and thus the other half of that charging wave is redirected to storage means C1 (which by nature of its higher capacity limits the coil output voltage for that half wave). The rectifier arrangement of diodes D4 and D7 and D6 and D3 allows all of the current generated by this coil (L2) to be delivered into charge storage means C1 and C2. The diode D5 serves as a charge isolation means between the charge storage means C1 and C2.

The low capacitance capacitor (C2) may be selected from a range of capacitances of 0.47 $\mu$F to 4.7 $\mu$F. The higher capacitance capacitor (C1) may be selected from a range of capacitances of 22 $\mu$F to 680 $\mu$F. Capacitance values outside these ranges may be used, but it has been determined that such values, if used, are unlikely to have any additional benefit in achieving extended spark duration or delivery.

Furthermore, the ratio of capacitors C2:C1 has been found to be optimum in the range of 1:20 to 1:200.

In addition, it has been found that in general the higher the capacitance value selected for C1, the more energy that is able to be stored, and thus the longer the spark duration delivered.

In the present embodiment, each of the two charge coils L1 and L2 develop a full wave in phase for at least one charge cycle per discharge cycle for delivery to capacitors C1 and C2, there being potentially more than one one charge cycle per discharge cycle in the system.

The significant change in the charging is that instead of using one half wave from a single charge coil to charge storage means C1 and the other half wave for storage means C2 (until a nominal voltage of say 300 V is attained and then applying this second half wave to further charge storage means C1), two charge coils are used wherein three half waves now charge storage means C1 and one half wave charges storage means C2. The storage isolation means D5 may then be a lower cost diode instead of higher cost zener diode(s).

The delivery of three half waves and one half wave are enabled by redirecting part of the charge from one coil (L2) to one of the capacitors (C1). It has also been found that by providing to one charge storage means (i.e: C1) three half waves, that charge storage means can be provided in the form of a higher value component, and thus store more energy, resulting in an increased delivery of energy/charge for providing a spark of increased duration at the spark gap S1.

As a further alternative, it may also be possible to re-direct one half wave from L1 to C2 in a similar fashion to that noted above. Hence, in such an alternative, the charge coils L1 and L2 provide three half waves to charge storage means C2 and a single half wave from L1 is used to charge storage means C1. However, this alternative would require a zener diode in place of diode D5 of FIG. 1 and so the advantage of avoiding the use of a zener diode is diluted.

Figure 2:
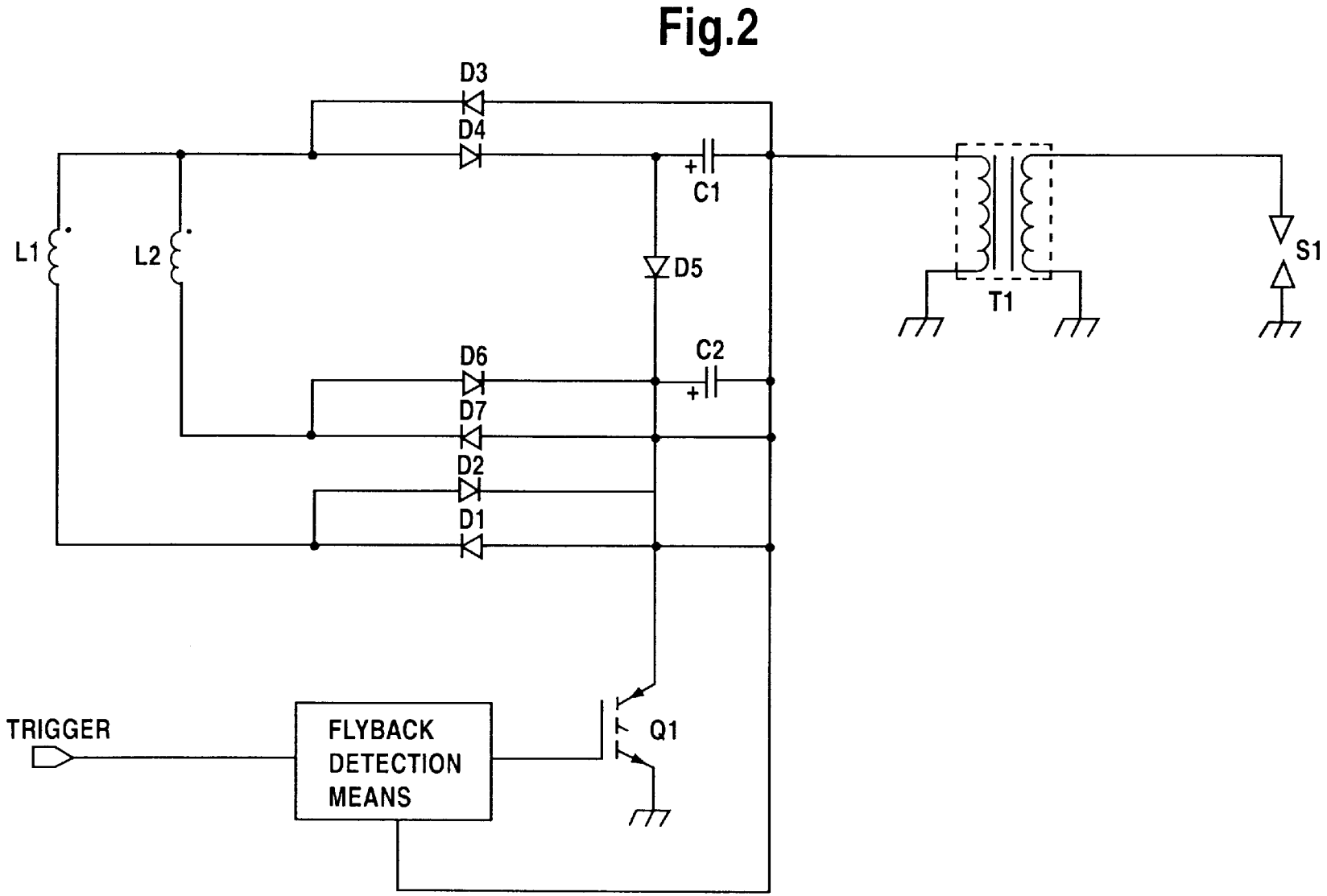
FIG. 2 shows a schematic diagram of a second form of ignition system in accordance with the present invention.

FIG. 2 shows a further embodiment in which the charge storage means C1 is charged with separate half waves from the respective charge coils (L1 and L2). The rectifier arrangement of diodes D4, D1 and D7 allows the two half waves to be delivered into charge storage means C1.

Similarly, the other charge storage means C2 is also charged with separate half waves from the respective charge coils (L1 and L2). The rectifier arrangement of diodes D2, D3 and D6 allows the two half waves to be delivered into charge storage means C2.

Hence, in this embodiment, both the charging waves of charge coils L1 and L2 are split to charge storage means C1 and C2. Each of the two charge coils L1 and L2 develop a full wave in phase for at least one charge/discharge cycle per discharge cycle for delivery to capacitors C1 and C2. Though the charging sequence is different to that described for the embodiment as shown in FIG. 1, the operation and structure are in accordance with the invention.

It should be noted that there is a limit to the amount of charge that can be transferred into the spark gap S1. This limit is dependent on the efficiency of the ignition coil $T_1$ to transfer energy from the primary winding into the secondary winding; that is, the slowest rate of change of primary current which will be transformed into the secondary winding. This occurs until the rate of change of current is so slow as to not induce a current into the secondary winding. At this point a flyback commences in the same fashion as described in the Applicant's prior patent application referred to hereinbefore. With the large capacitance capacitor C1 set to around 470 $\mu$F, it has been found that the rate of change of current delivered to the primary winding of the ignition coil $T_1$ approaches a performance result which is sufficient to meet current engine requirements.

Another side effect of the rate of change of the current is that the secondary or flyback spark is of higher energy and longer duration than was previously possible.

Furthermore, as shown in FIG. 1, a significant enhancement has been attained in the embodiment as disclosed by replacing the switching device and flyback control means of FIG. 2 of PCT/AU91/00524 with a single transistor Q1. Preferably, the transistor is an insulated gate bipolar transistor (IGBT) of a suitable rating.

The present invention may also be utilized in existing capacitative or non-capacitative ignition systems. It may also be possible to substitute for capacitors C1, C2 (as disclosed in FIGS. 1 and 2) batteries B1,B2 for use as charge storage means. The batteries would also require to be adapted to high and low voltage operation in a similar fashion to the embodiments shown in FIGS. 1 and 2. In this alternative configuration, the ignition system may be similarly wired, except for some changes necessitated due to the use of batteries rather than capacitors, as would be known by an artisan. The same or a similar charging methodology can be implemented in such an alternative ignition system.

The invention is equally applicable in a system including any desired number of charge coils, charge storage means and charge storage isolation means. Therefore, the embodiments described are indicative only and other variations may be developed by the skilled artisan which still fall within the scope of the present invention.

We claim:

1. An ignition system comprising two chargers which produce charge simultaneously and two charge storage elements, one of said chargers providing a part of its charge to each of the charge storage elements, the other providing all of its charge to only one of the charge storage elements, both charge storage elements collectively activating a spark element for providing an ignition spark, wherein said spark element comprises a primary coil and a secondary coil connected to a spark gap, and outputs of both said charge storage elements are connected to said primary coil of said spark element.

2. The ignition system as claimed in claim 1, characterised in that said plurality of charge storage elements includes charge storage elements of differing storage capacity.

3. The ignition system as claimed in claim 1, characterised in that at least two chargers means are arranged to provide at least part of the charge for at least one charge element means.

4. The ignition system as claimed in claim 1, characterised in that charge output by at least one charger substantially corresponds to the capacity of at least one charge storage element.

5. The ignition system as claimed in claim 1, characterised in that at least one charge storage element has high storage capacity and at least one other charge storage element has low storage capacity.

6. The ignition system as claimed in claim 1, characterised in that said system is a capacitive discharge ignition system.

7. The ignition system as claimed in claim 1, characterised in that two charge storage elements are included and the ratio of capacitance between both charge storage elements is between 1:20 and 1:200.

8. An ignition system as claimed in claim 1 characterised in that said spark means ignites fuel in an internal combustion engine.

9. The ignition system of claim 1 wherein one half-wave of a cyclic charging wave of one charger charges one charge storage element and the other half-wave of said cyclic charging wave charges the other charge storage element.

10. The ignition system of claim 1, wherein each of the two chargers have only two terminals.

11. A method of providing charge in an ignition system to charge storage elements, comprising the steps of:

simultaneously producing first and second charges respectively with first and second chargers;

distributing the first charge from the first charger to both of two charge storage elements; and distributing all of the second charge from the second charger to only one of the said two charge storage elements.

12. The method as claimed in claim 11, characterised in that said charge storage elements include charge storage elements of differing storage capacity.

13. The method as claimed in claim 11, characterised in that at least two chargers provide at least part of the charge for at least one charge storage element.

14. The method as claimed in claim 11, characterised in that at least one charge storage element has high storage capacity and at least one other charge storage element has low storage capacity.

15. The method as claimed in claim 11, characterised in that charge is provided to charge the storage means in an unbalanced manner such that at least one charge storage element receives more charge than another charge storage element.

16. The method as claimed in claim 11, characterised in that charge output by at least one charger substantially corresponds to the capacity of at least one of said charge storage elements.

17. The method as claimed in claim 11 wherein said ignition system is used for ignition of an internal combustion engine.

18. The method of claim 11 wherein one half-wave of a cyclic charging wave of the first charger charges one charge storage element and the other half-wave of said cyclic charging wave charges the other charge storage element.

19. The method of claim 11, wherein each of the first and second chargers have only two terminals.

20. A method of providing charge to a spark gap in an ignition system, said ignition system comprising a primary coil inductively coupled to a secondary coil, said secondary coil in turn being connected to said spark gap, comprising the steps of:

simultaneously producing first and second charges respectively with first and second chargers;

distributing the first charge from the first charger to each of two charge storage elements;

distributing all of the second charge from the second charger to only one of the charge storage elements; and distributing charge from the two charge storage elements to said primary coil of said ignition system to produce a spark in said spark gap.

21. The method of claim 20 wherein one half-wave of a cyclic charging wave of the first charger charges one charge storage element and the other half-wave of said cyclic charging wave charges the other charge storage element.

22. The method of claim 20, wherein each of the first and second chargers have only two terminals.

23. A method of providing charge in an ignition system to charge storage elements, comprising the steps of:

alternately distributing the charge from one of two chargers between two charge storage elements; and distributing the charge from the other charger to only one of said two charge storage elements simultaneously with each alternately distributed charge.

24. The method of claim 23, wherein each of the two chargers have only two terminals.

* * * * *